US005775919A

United States Patent [19]

Gardner

[11] Patent Number: 5,775,919

[45] Date of Patent: Jul. 7, 1998

[54] COMBINATION BULLETIN/WRITE BOARD

[75] Inventor: Marshall Gardner, Chicago, Ill.

[73] Assignee: Right Message, L.L.C., Chicago, Ill.

[21] Appl. No.: 800,205

[22] Filed: Feb. 12, 1997

[51] Int. Cl.[6] ..... B43L 1/00

[52] U.S. Cl. ..... 434/408; 40/606; 434/430

[58] Field of Search ..... 434/408, 419, 434/421, 425, 430; 40/606, 492

[56] References Cited

U.S. PATENT DOCUMENTS

| | | | |
|---|---|---|---|
| 3,502,295 | 3/1970 | Sganga . | |
| 4,098,009 | 7/1978 | Flynn . | |
| 4,213,520 | 7/1980 | Sarna et al. . | |
| 4,906,025 | 3/1990 | Schreindl | 281/45 |
| 5,131,849 | 7/1992 | Perrero | 434/408 X |
| 5,145,141 | 9/1992 | Hunter . | |
| 5,441,228 | 8/1995 | Geborek . | |
| 5,595,009 | 1/1997 | Rummer | 40/606 |

FOREIGN PATENT DOCUMENTS

| | | | |
|---|---|---|---|
| 740154 | 8/1966 | Canada | 434/425 |
| 95/00938 | 1/1995 | WIPO | 434/430 |

*Primary Examiner*—Jeffrey A. Smith
*Attorney, Agent, or Firm*—Silverman, Cass & Singer, Ltd.

[57] ABSTRACT

A bulletin/write board includes opaque first member intended to be mounted on a wall or positioned upstanding on a horizontal surface. At least one overlay member is pivotally secured to said first member along juxtaposed edges of said members by a spirally wound hinge to permit the overlay member to be pivoted over or away from said first member. Said members are generally rigid and have smooth surfaces which permit removable adhesive placement of note items or wipe-off writings thereon. Fasteners are provided to permit selective fastening of said overlay member to said first member when the overlay member is positioned over said first member.

7 Claims, 2 Drawing Sheets

FIG. 1
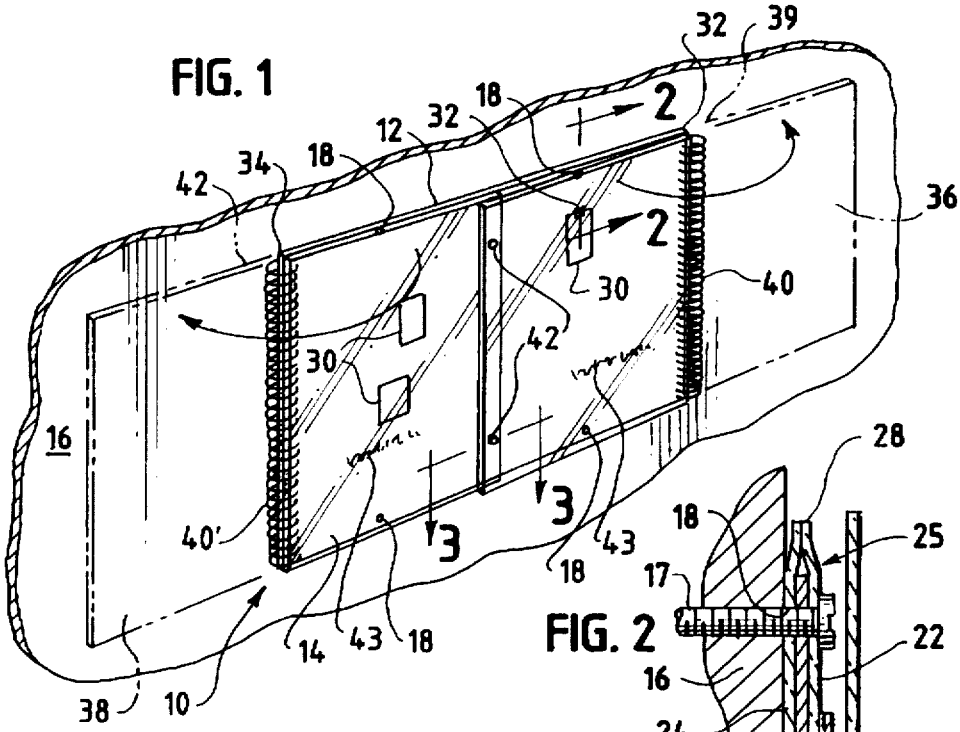
FIG. 2
FIG. 3
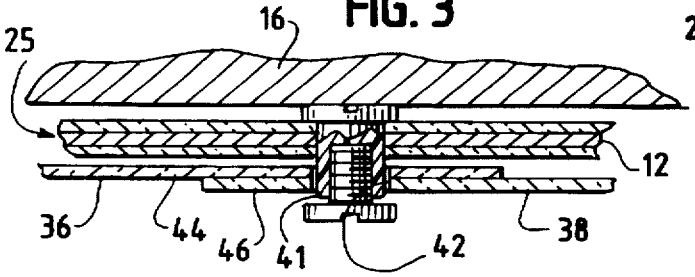
FIG. 4
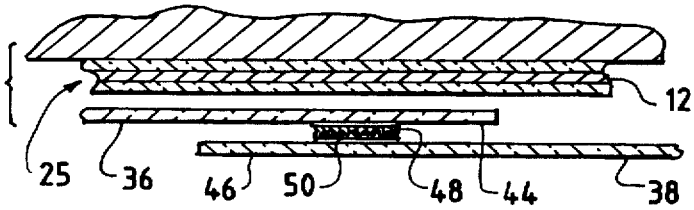
FIG. 5
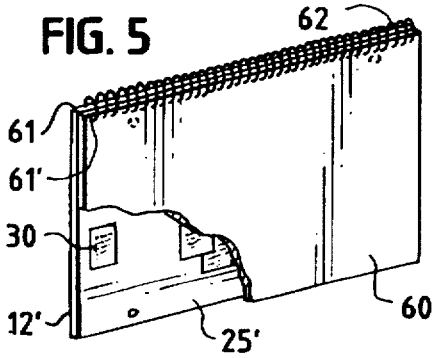
FIG. 6
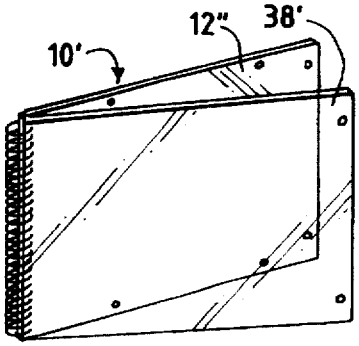

COMBINATION BULLETIN/WRITE BOARD

BACKGROUND OF THE INVENTION

1. Field of the Invention

This invention relates generally to bulletin boards and write boards, and more particularly, to combination bulletin/write boards with overlying covers connected by spirally wound hinge members.

2. Description of the Prior Art

It is known to provide bulletin boards for mounting and displaying of note papers, photos or the like. It also is known to provide write boards for displaying written words or indicia which are applied to a smooth surface of the boards with wipe-off markers.

Such bulletin boards commonly include a cork or similar soft board member intended to be supported on a vertical surface to receive papers, etc., in mounted fashion by pins or other fasteners. Such bulletin boards also commonly include overlay doors of clear acrylic material which can be closed over, but spaced from, the cork member, to enable viewing of said pinned papers while the same are protected from removal. The overlay doors of prior art bulletin boards must be spaced from the cork member in order to provide room for the pins or other fasteners which mount the papers on the cork member.

It is not known to provide bulletin boards having a smooth surface for removable mounting thereon of note papers and the like by adhesive or tape, with overlay covers adapted to be positioned closely against said smooth surface to protect said mounted papers and prevent inadvertent removal thereof. It also is not known to provide write boards with overlay covers to prevent inadvertent wipe-off of words applied thereto. Further, it is not known to provide combination bulletin/write boards which have the desired features of both bulletin boards and write boards presented in one construction.

Accordingly, it is desired to provide a combination bulletin/write board that permits both mounting and displaying of papers or the like, together with a writing surface on which wipe-off markings can be applied as desired. Such combination bulletin/write boards also preferably include an overlay member which can selectively be pivotally positioned over the surface of the combination bulletin/write board to protect the papers and writings mounted and/or applied thereto. It also is desired to provide such a combination bulletin/write board which can fold flat when not in use, and which is portable for convenient transport.

The present invention provides a combination bulletin/write board which is of uncomplicated construction and yet achieves the advantages of permitting papers or the like to be removably positioned on its mounting surface and also wipe-off markings to be applied to the same surface, such papers and markings being protected from unintended removal by an overlay member which can selectively be positioned and secured over the mounting surface.

SUMMARY OF THE INVENTION

The invention is characterized by a bulletin/write board having a smooth mounting surface for removable receipt thereon of note papers or the like by adhesive or tape. Said smooth surface also can receive wipe-off writings that may be applied with a marker. At least one overlay cover is pivotally secured to the bulletin/write board by a spirally wound hinge co-joining a respective edge of the bulletin/write board and the cover. The cover thereby may selectively be positioned over the bulletin/write board to protect papers and/or writings applied thereto. Fastening means are provided to secure the cover when it is positioned over the bulletin/write board.

Various objects and advantages of the invention will become apparent in accordance with the above and ensuing disclosure in which the preferred embodiments are described in detail in the specification and illustrated in the accompanying drawings. It is contemplated that minor variations may occur to the skilled artisan without departing from the scope or sacrificing any of the advantages of the invention.

BRIEF DESCRIPTION OF THE DRAWINGS

FIG. 1 is a perspective view of a bulletin/write board constructed in accordance with the invention;

FIG. 2 is a sectional view taken along the line 2—2 of FIG. 1, in the direction indicated generally;

FIG. 3 is a sectional view taken along the line 3—3 of FIG. 1, in the direction indicated generally;

FIG. 4 is a sectional view similar to that of FIG. 3, showing an alternate fastener to secure the overlay covers of the invention;

FIG. 5 is a perspective view of an alternate embodiment of a bulletin/write board constructed in accordance with the invention;

FIG. 6 is a perspective view of a further alternate embodiment of a bulletin/write board constructed in accordance with the invention;

DESCRIPTION OF THE PREFERRED EMBODIMENTS

Figure 7:
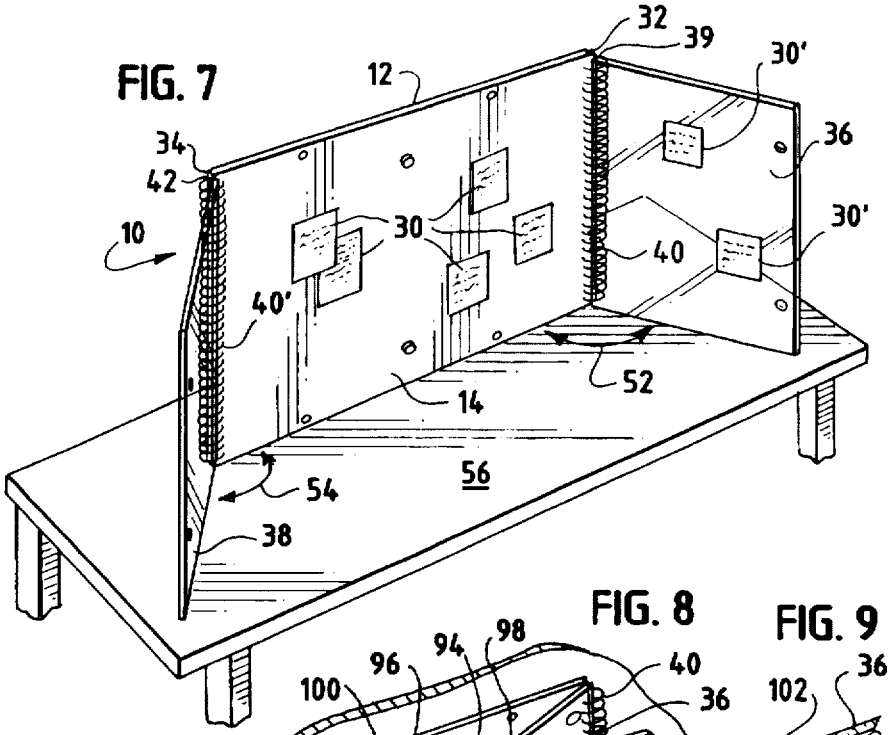
FIG. 7 is a perspective view of the bulletin/write board illustrated in FIG. 1, the same being shown in its open position and disposed on a horizontal surface.

The bulletin/write board 10 of the invention is illustrated in FIGS. 1–4 and 7 of the drawings. The board 10 includes a first member 12 having a smooth front-facing surface 14. In FIG. 1, the board 10 is shown positioned on a vertical wall 16, in which case the first member 12 is attached to the wall 16 by conventional fasteners 17 which pass through apertures 18 provided in member 12. The rear surface 20 of member 12 abuts wall 16 in this disposition.

Smooth front-facing surface 14 preferably is formed of acrylic material, such as clear plastic. In the preferred embodiment of FIG. 1, and as best seen in FIG. 2, member 12 is formed of two layers of such acrylic material, a first layer 22 which carries front-facing surface 14, and a second layer 24 which carries rear surface 20. The two layers 22, 24 are sandwiched over a third layer 26 of opaque material, with the peripheral edges 28 of layers 22, 24 joined in conventional manner, such as by heat treatment to form a laminate 25. In this manner, member 12 is relatively rigid and has the appearance of an opaque member because clear front-facing surface 14 permits the opaque layer 26 to be viewed.

By reason of the smooth front-facing surface 14, note papers, photos or the like items 30 may be removably affixed thereto by tape 32 or adhesive, as desired. The smooth surface permits application and removal of such items 30, as desired, after which the surface 14 may be wiped clean for re-use. Smooth front-facing surface 14 also may receive markings such as writings applied directly thereon by markers (not shown), which markings can be wiped off when desired. Thus, the smooth surface 14 can receive and carry both tape and/or adhesive-applied but removable papers, and wipe-off markings in any desired random location thereon.

Attached to opposite vertical edges 32, 34 of first member 12 are respective overlay covers 36, 38. Each cover 36, 38 is formed of a clear acrylic, relatively rigid material. Vertical edge 39 of cover 36 is attached to edge 32 of first member 12, and vertical edge 42 of cover 38 is attached to edge 34 of first member 12. The respective covers 36, 38 are attached to first member 12 by respective spirally wound hinge members 40, 40' co-joining the associated edges of the covers and the first member. The spirally wound hinge members 40, 40' permit covers 36, 38 to alternately be positioned over first member 12 in closely-spaced relationship thereto as shown in solid outline in FIG. 1, or moved to fully opened position away from first member 12 as shown in dotted outline in FIG. 1. Hinge members 40, 40' may be formed of spirally wound plastic or metal coil material, or any other suitable material. The coils of hinge member 40, 40' are positioned in respective apertures formed in the edges 32, 34, 40, 42 of member 12 and covers 36, 38 in conventional manner.

When covers 36, 38 are disposed in overlaying fashion with respect to first member 12 (solid outline in FIG. 1), the items 30 and markings 43 on said first member are protected from inadvertent removal. Yet, by reason of the fact that covers 36, 38 are formed of clear acrylic material, the items 30 and markings are fully visible for display.

Removable fasteners 41 (FIG. 3) are provided to secure covers 36, 38 together when they are disposed in overlapping fashion with respect to first member 12. Such fasteners 41 pass through apertures 42 provided along peripheral overlaying edges 44, 46 of covers 36, 38. Alternatively, as shown in FIG. 4, mating VELCRO hook—and—loop fastening strips 48, 50 can be provided on respective overlapping edges 44, 46 of covers 36, 38 to provide securement means for the covers when they are positioned over first member 12.

As seen in FIG. 7, bulletin/write board 10 also can be used as a free-standing display board without being attached to wall 16. The free-standing disposition of board 10 is accomplished by moving covers 36, 38 into partially opened position with respect to first member 12, thereby forming obtuse angles 52, 54 between the respective surfaces of the covers and member 12. Since covers 36, 38 can freely be moved with respect to member 12 by reason of spirally wound hinge members 40, 40', the disposition shown in FIG. 7 is conveniently achieved and bulletin/write board 10 can be disposed in free-standing display orientation, such as on horizontal table surface 56. Also by reason of the convenient opening/closing operations of covers 36, 38 with respect to member 12, bulletin/write board 10 is portable and can readily be transported when the covers are moved to closed disposition (solid outline in FIG. 1).

When board 10 is used as a free-standing item as shown in FIG. 7, covers 36, 38 can additionally function as item holding surfaces, such as for items 30' shown positioned thereon.

While in the preferred embodiment of FIGS. 1 and 7 the bulletin/write board 10 includes two covers 36, 38, the invention contemplates alternate embodiments shown in FIGS. 5 and 6. In the embodiment of FIG. 5, first member 12' has a single cover 60 associated therewith. The member 12' and cover 60 are co-joined along top edges 61, 61' thereof by spirally wound hinge member 62 in the same manner as hinge members 40, 40' in the embodiment of FIGS. 1 and 7. In the FIG. 5 embodiment, member 12' is a laminate 25' formed in the same manner as laminate 25. In this embodiment, cover 60 is illustrated also as an opaque laminate formed in the same manner as laminate 25 so that both portions 12' and 60 can function to receive items 30 or markings on the innerfacing surfaces thereof when portions 12' and 60 are closed with the inner-facing surfaces thereof abutting each other. In the embodiment of FIG. 6, the first member 12" is substantially the same as member 12, and cover 38' is substantially the same as cover 38, but cover 36 has been omitted to provide a bulletin/write board 10' with one cover 38' only.

Figure 8:
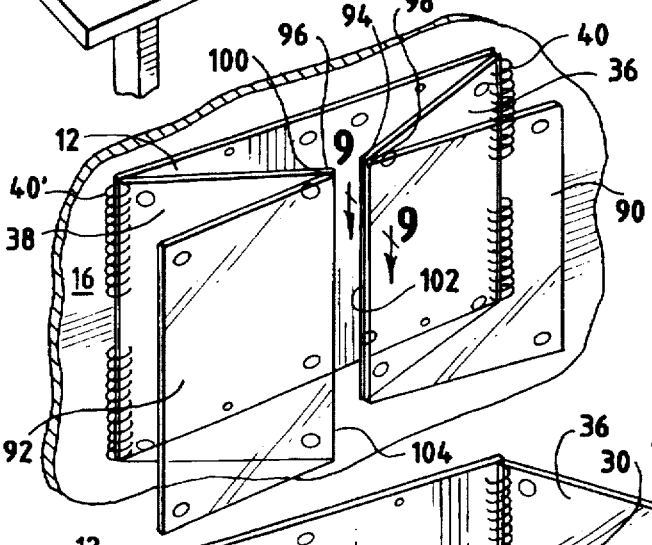
FIG. 8 is a perspective view of a further alternate embodiment of a bulletin/write board constructed in accordance with the invention.
Figure 9:
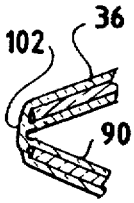
FIG. 9 is a sectional view taken along the line 9—9 of FIG. 8, in the direction indicated generally.
Figure 11:
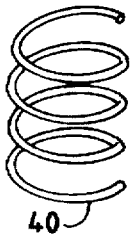
FIG. 11 is a perspective view of a portion of the spirally wound hinge member of the invention.
Figure 10:
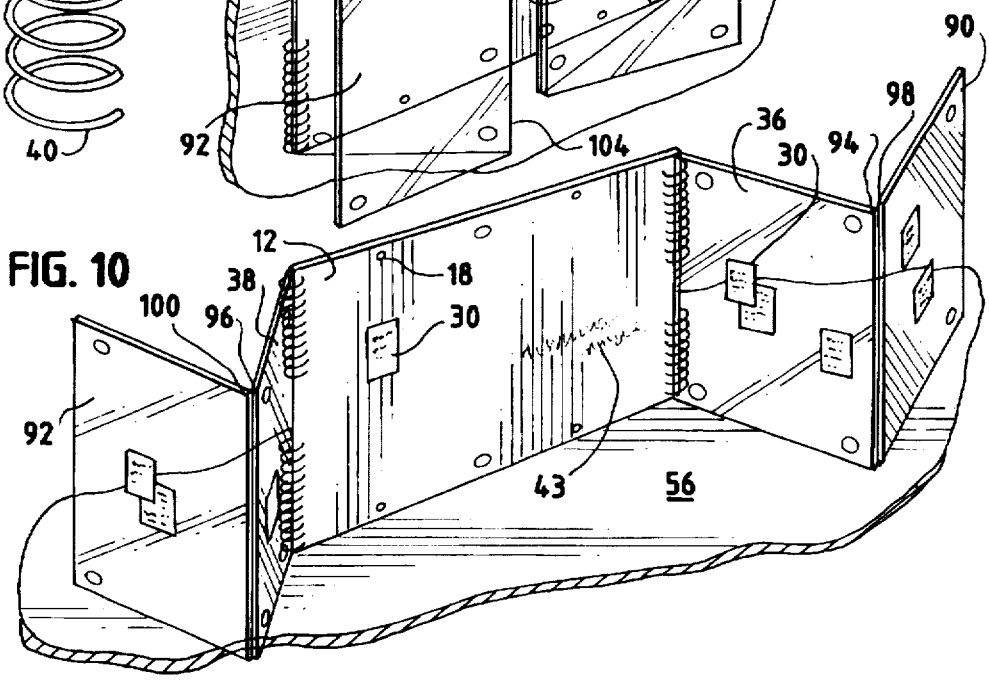
FIG. 10 is a perspective view of the bulletin/write board illustrated in FIG. 8, the same being shown in its open position and disposed on a horizontal surface.

The invention contemplates a further alternate embodiment as shown in FIGS. 8–10. In this embodiment, additional covers 90, 92 are co-joined to respective free edges 94, 96 of covers 36, 38 of the FIGS. 1 and 7 embodiments along edges 98, 100 thereof. Thus, multiple covers are provided to overlay first member 12 in closed position (shown in partial development in FIG. 8) or in opened, free-standing disposition shown in FIG. 10.

The co-joined edges 98, 100 of additional covers 90, 92 can respectively be attached to edges 94, 96 of covers 36, 38 by spirally wound hinge members similar to hinge members 40, 40', or by integrally-formed hinge webs 102, 104 best seen in FIG. 9. Further additional covers could be attached to covers 90, 92 in similar manner to expand the display surface of the disclosed bulletin/write board. In all other respects, the embodiment of FIGS. 8–10 is constructed and is usable in the same manner as the previously disclosed embodiments.

The bullet/write board of the invention provides all of the desired advantages not available with previously known constructions. The various embodiments enable note or similar items to be displayed without the use of pin-type fasteners, together with write-on/wipe-off markings. Single cover or multiple cover configurations are obtainable. The spirally wound hinge member 40 can be positioned on the top or on the side edge of the first member 12, as desired. Clear acrylic or opaque appearance surfaces can be provided for one or all members/covers for additional versatility of the invention. By reason of the spirally wound hinge members, the invention is readily portable and adaptable to permanently-mounted or movable display type usage, as desired. When the covers are disposed over the first member 12, the invention folds flat to occupy minimal space for transport or when wall-mounted. Addition of multiple covers which can be folded over each other in accordion-like fashion permits the item display surface of the invention to be expanded to provide full-size show displays.

Minor variations in the structure and other variations in the arrangement and size of the various parts may occur to those skilled in the art without departing from the spirit or circumventing the scope of the invention as set forth in the appended claims.

I claim:

1. A combination bulletin/write board comprising, a first member having a smooth surface for removable receipt thereon of adhesive placed items and wipe/off markings, said first member having a first straight edge and a second straight edge, one overlay cover with a first straight edge pivotally secured to the first straight edge of said first member and a second overlay cover with a first straight edge pivotally secured to the second straight edge of said first member, and respective hinge members co-joining said first member and said covers along said straight edges, whereby said covers may selectively be positioned in abutting disposition over said smooth surface to protect said items and markings from unintended removal thereof, said covers respectively having free edges spaced from their first straight edges, said free edges being disposed in abutting disposition with respect to each other when they are positioned over said smooth surface, and fastening means to removably fasten the covers to each other and to the first member when the covers are positioned over said smooth surface.

2. A combination bulletin/write board as claimed in claim 1 in which said hinge members are formed of spirally wound hinge coils.

3. A combination bulletin/write board comprising, a first member having a smooth surface for removable receipt thereon of adhesive placed items and wipe/off markings, said first member having a first straight edge and a second straight edge, one overlay cover with a first straight edge pivotally secured to the first straight edge of said first member and a second overlay cover with a first straight edge pivotally secured to the second straight edge of said first member, and respective hinge members co-joining said first member and said covers along said straight edges, whereby said covers may selectively be positioned in abutting disposition over said smooth surface to protect said items and markings from unintended removal thereof, said covers respectively having free edges spaced from their first straight edges, said free edges being disposed in abutting disposition with respect to each other when they are positioned over said smooth surface, and at least one additional cover having a straight edge pivotally secured to a free edge of one of said first or second covers.

4. A combination bulletin/write board as claimed in claim 3 including fastening means to removably fasten the covers to the first member when the covers are positioned over said smooth surface.

5. A combination bulletin/write board as claimed in claim 4 in which the fastening means are mating hook-and-loop fastening strips positioned on the first member and the covers.

6. A combination bulletin/write board as claimed in claim 4 in which the fastening means pass through registered apertures provided in the first member and the covers.

7. A combination bulletin/write board as claimed in claim 3 in which the additional cover is secured to said first named cover by a hinge web.

* * * * *